US006102684A

United States Patent [19]

Tuckey

[11] Patent Number: 6,102,684

[45] Date of Patent: Aug. 15, 2000

[54] CAVITATION NOISE ABATEMENT IN A POSITIVE DISPLACEMENT FUEL PUMP

[75] Inventor: Charles H. Tuckey, Sand Point, Mich.

[73] Assignee: Walbro Corporation, Cass City, Mich.

[21] Appl. No.: 09/152,779

[22] Filed: Sep. 14, 1998

[51] Int. Cl.[7] ..... F04C 18/00

[52] U.S. Cl. ..... 418/171; 418/166; 418/15

[58] Field of Search ..... 418/171, 166, 418/15

[56] References Cited

U.S. PATENT DOCUMENTS

| | | | |
|---|---|---|---|
| 3,830,255 | 8/1974 | Freiheit | 137/543.19 |
| 5,035,588 | 7/1991 | Tuckey . | |
| 5,122,039 | 6/1992 | Tuckey | 417/366 |
| 5,887,798 | 7/1997 | Ohta et al. | 239/585.1 |
| 5,967,166 | 1/1998 | Carter | 137/1 |
| 5,997,262 | 4/1997 | Finkbeiner et al. | 417/410.4 |

FOREIGN PATENT DOCUMENTS

| | | | |
|---|---|---|---|
| 405263770 | 3/1992 | Japan | 418/171 |
| 2069609 | 3/1992 | United Kingdom | 418/171 |

*Primary Examiner*—Thomas Denion
*Assistant Examiner*—Theresa Trieu
*Attorney, Agent, or Firm*—Reising, Ethington, Barnes, Kisselle, Learman & McCulloc, P.C.

[57] ABSTRACT

A positive displacement gear rotor fuel pump with a plurality of spaced apart outlet ports through which fuel is discharged from a fuel pumping assembly and a valve which prevents any fuel downstream of the outlet ports which is at outlet pressure, from reentering portions of the pumping assembly which are at a lower pressure to prevent the higher pressure fuel from rapidly compressing and collapsing the fuel vapor in the pumping assembly to greatly reduce the noise of the operating fuel pump. This reduces the magnitude of the cavitation noise in the fuel pump which is the noise caused by the collapsing of the fuel vapor in the pump. The outlet ports are also constructed and arranged to prevent adjacent pumping chambers of the pumping assembly from communicating with each other to prevent the fuel at an increased pressure in a downstream pumping chamber from flowing into a lower pressure pumping chamber upstream thereof to also reduce cavitation noise in the fuel pump.

20 Claims, 3 Drawing Sheets

CAVITATION NOISE ABATEMENT IN A POSITIVE DISPLACEMENT FUEL PUMP

FIELD OF THE INVENTION

This invention relates generally to fuel pumps and more particularly to a positive displacement fuel pump having improved vapor handling capability and a reduction in audible noise produced by cavitation in use.

BACKGROUND OF THE INVENTION

Positive displacement fuel pumps, such as gear rotor type fuel pumps have been widely used to pump various liquids including hydrocarbon fuels such as gasoline. These pumps utilize mating inner and outer gears which, when driven to rotate, produce enlarging and ensmalling chambers which draw fuel into the pump and discharge fuel under pressure from the pump. Prior gear rotor type fuel pumps have cavitation noise problems when used to pump hydrocarbon fuels such as gasoline due to the tendency of such fuels to form vapor when exposed to decreased pressures, such as at the fuel pump inlet, and increased temperature which can occur within a vehicle's fuel tank and fuel system. The liquid fuel in a vehicle's fuel tank can become heated up to or near the temperature required for the liquid fuel to vaporize as the vehicle is operated or remains stationary in hot weather conditions. Heated fuel can also be returned to the fuel tank from a hot engine fuel rail or a fuel pressure regulator or other device disposed adjacent a hot fuel rail or engine. Due to the increased temperature of the fuel and the low pressure at the fuel pump inlet, under some conditions, there can be as much as 60% fuel vapor by volume within the fuel pumping chambers of the fuel pump.

As the amount of fuel vapor increases, the noise of the fuel pump in operation increases and, the efficiency of the fuel pump drops as a lower flow rate of liquid fuel is discharged from the pump. The noise is due in great part to cavitation, or the collapsing of the vapor pockets within the fuel pump as the relatively high pressure adjacent the outlet of the fuel pump rapidly and somewhat violently collapses the vapor within fuel pumping chambers which are at a lower pressure. Each time this occurs, an audible noise is produced. In use, due to the relatively high speed at which the gears are rotated, this occurs at such a high frequency that a loud humming noise is produced from the fuel pump. This loud noise in operation is very undesirable and is an even greater problem when the fuel pumps are mounted within a vehicle fuel tank which tends to amplify the noise of the fuel pump.

Additionally, prior fuel pump constructions, such as that disclosed in U.S. Pat. No. 5,035,588 have a flexible seal disposed against the downstream face of the gear rotors. These pumps are useful and relatively economical to manufacture and assemble for most automotive application. However, in high output pressure applications, such as marine engine applications wherein the fuel pump output pressure may be 90 psi or greater, the pressure differential across the flexible seal adjacent the pump inlet tends to force the seal firmly against the rotating gears which increases the wear on the seal and reduces the durability and service life of the fuel pump.

SUMMARY OF THE INVENTION

A positive displacement gear rotor fuel pump with a plurality of spaced apart outlet ports through which fuel is discharged from a fuel pumping assembly and a valve which prevents any fuel downstream of the outlet ports which is at outlet pressure, from reentering portions of the pumping assembly which are at a lower pressure to prevent the higher pressure fuel from rapidly compressing and collapsing the fuel vapor in the pumping assembly to greatly reduce the noise of the operating fuel pump. This reduces the magnitude of the cavitation noise in the fuel pump which is the noise caused by the collapsing of the fuel vapor in the pump. The outlet ports are constructed and arranged to prevent adjacent pumping chambers of the pumping assembly from communicating with each other to prevent the fuel at an increased pressure in a downstream pumping chamber from flowing into a lower pressure pumping chamber upstream thereof to also reduce cavitation noise in the fuel pump.

By preventing the fuel at an increased pressure, either from one or more downstream pumping chambers or from downstream of the outlet ports, from entering an upstream pumping chamber, the pressure within the upstream pumping chamber is more gradually increased as the gears rotate due to the reduction in volume of that pumping chamber. This more gradually compresses and transforms the fuel vapor therein to liquid fuel producing less cavitation noise which is greatly decreased from the cavitation noise produced by prior fuel pumps. Thus, the construction and arrangement of the outlet ports and the valve associated therewith provide a fuel pump which has a significant reduction in the noise caused by cavitation within the operating fuel pump.

Objects, features and advantages of this invention include providing a fuel pump with a plurality of spaced apart outlet ports and a valve associated with those outlet ports which greatly reduces the noise due to cavitation in the fuel pump during use, improves the efficiency of the fuel pump, reduces leakage within the fuel pumping mechanism, can be used with fuel pumps operating at extremely high pressures, is of relatively simple design and economical manufacture and assembly, is rugged, durable and reliable and in service has a long, useful life.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF THE PREFERRED EMBODIMENTS

Figure 1:
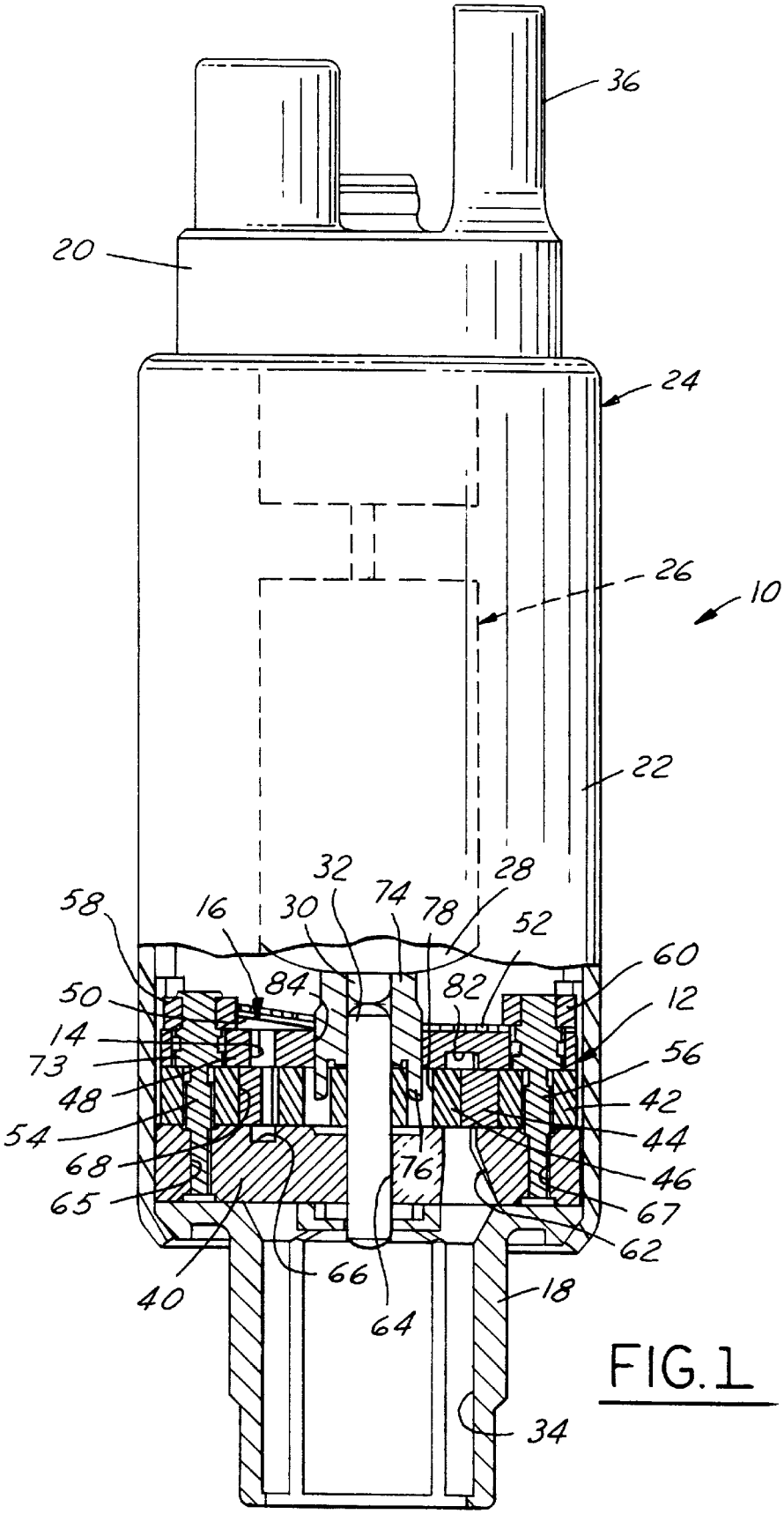
FIG. 1 is a side view with portions broken away and in section of a positive displacement fuel pump embodying this invention.

Referring in more detail to the drawings, FIG. 1 shows an electric fuel pump 10 with a positive displacement gear rotor fuel pump assembly 12 embodying this invention and having a plurality of spaced apart outlet ports 14 through which fuel is discharged under pressure and a valve 16 which controls the flow of fuel through the outlet ports 14. The fuel pump 10 has an inlet end cap 18 and an outlet end cap 20 axially spaced apart and received in a shell 22 to form a unitary hollow pump housing assembly 24. The fuel pump assembly 12 is driven by an electric motor 26 received in the housing 24 with an armature 28 received in a stator (not shown) and journalled between the inlet and outlet end caps 18, 20 by a stub shaft 30 which bears on and rotates against a mounting shaft 32 received through the fuel pump assembly 12. The fuel pump assembly 12 draws fuel through an inlet passage 34 of the inlet end cap 18 and delivers fuel under pressure through an outlet passage 36 formed through the outlet end cap 20.

In assembly, the inlet end cap 18 butts against the fuel pump assembly 12 which has an inlet port plate 40, a cam ring 42, an outer gear rotor 44, an inner gear rotor 46, an outlet port plate 48, and the valve 16 which comprises a sealing ring 50 and a seal support plate 52, all held together by a pair of bolts 54, 56 and associated nuts 58, 60. The motor 26 is disposed downstream of the fuel pump assembly 12.

The inlet port plate 40 is disposed between the inlet end cap 18 and the cam ring 42 with a slight clearance gap between the inlet port plate 40 and the gear rotors 44, 46. The inlet port plate 40 has an inlet port 62 in communication with the inlet passage 34, a central through bore 64 which receives the mounting shaft 32 and a recess 66 adjacent the outlet side of the pump assembly 12 which communicates with at least some of the outlet ports 14 to more evenly distribute the force of the pressurized fuel across the gear rotors 44, 46. A pair of threaded holes 65, 67 each receive a threaded end of one bolt 54, 56.

The cam ring 42 has a large cylindrical bore 68 which is positioned off center from the axis of rotation of the armature 28. The cam ring has a pair of diametrically opposed holes 69, 71 which receive the bolts 54, 56 which themselves may have a radially extending shoulder 73 which clamps the cam ring 42 against the inlet port plate 40. The cam ring 42 is also clamped between the inlet port plate 40 and the outlet port plate 48 by the nuts 58, 60 which retain the outlet port plate 40 which has an axial height slightly greater than the axial height of the gear rotors 44, 46 to provide a slight clearance gap between the port plates 40, 48 and the gear rotors 44, 46. Typically, this total clearance between the port plates 40, 48 and the gear rotors 44, 46 is on the order of about 0.0004 inch to 0.0007 inch.

The outer gear rotor 44 is journalled for rotation in the cam ring bore 68 and has a plurality of radially inwardly extending teeth 70 (FIG. 2) which mate with a plurality of radially outwardly extending teeth 72 of the inner gear rotor 46 eccentrically received within the outer gear rotor 44. As shown, the outer gear rotor 44 has nine teeth 70 and the inner gear rotor 46 has eight teeth 72. The inner gear rotor 46 is coaxially journalled for rotation on the shaft 32. The inner gear rotor 46 is rotatably coupled to the stub shaft 30 through a coupler 74 (FIG. 1) having fingers 76 extending into circumferentially spaced holes 78 in the inner gear rotor 46. The inner gear rotor 46 is driven to rotate by the electric motor 26 of the fuel pump 10 and drives the outer gear rotor 44 for rotation within the bore 68 of the cam ring 42. The inner gear rotor 46 rotates on an axis generally coincident with the axis of rotation of the armature 28 which is parallel to and radially offset from the axis of rotation of the outer gear rotor 44 which rotates within the bore 68.

Circumferentially disposed enlarging and ensmalling pumping chambers 80 (FIG. 2) through which fuel is drawn and then discharged under pressure are defined between the teeth 70, 72 of the outer and inner gear rotors 44, 46. As the gear rotors 44, 46 rotate, the pumping chambers 80 move circumferentially between the gears 44, 46 starting from their minimum volume and enlarging to their maximum volume creating a drop in pressure to draw fuel therein. From their maximum volume the chambers 80 become increasingly smaller with continued gear rotation to increase the pressure of the fuel therein and discharge the fuel under pressure into the housing 24 and then through the outlet passage 36. For ease of description, the portion of the pump assembly 12 wherein the pumping chambers 80 are enlarging will be called the inlet side of the pump assembly 12 and wherein the pumping chambers 80 are ensmalling will be called the outlet side of the pump assembly 12.

The outlet port plate 48 has a recess 82 adjacent the inlet side of the pump assembly 12 which communicates with the inlet port 62 to more evenly distribute the forces across the gear rotors 44, 46 adjacent to the inlet port 62. A central through bore 84 receives the coupler 74 which extends into the inner gear rotor 46 to drive the inner gear rotor 46 and the plurality of independent, spaced apart outlet ports 14 are formed adjacent the outlet side of the pumping assembly 12. A pair of generally diametrically opposed holes 86, 88 through the outlet port plate 48 receive the bolts 54, 56 of the pumping assembly 12. One nut 58 directly clamps the outlet port plate 48 to the cam ring 42. The other nut 60 clamps the seal support plate 52 and sealing ring 50 of the valve 16 onto the outlet port plate 48 and thereby clamps the other side of the outlet port plate 48 to the cam ring 42.

Figure 7:
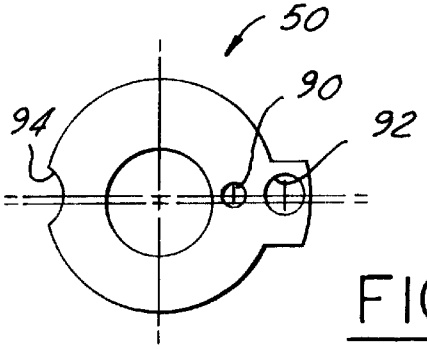
FIG. 7 is a top view of a seal of the fuel pumping assembly.

The sealing ring 50 is received on top of the outlet port plate 48 and is held thereon by a seal support plate 52 clamped between the outlet port plate 48 and the nut 60. As shown in FIG. 7, the sealing ring 50 is flat, thin and preferably formed from a metal suitable for use with hydrocarbon fuels, such as stainless steel. The sealing ring 50 permits fuel to flow through the outlet ports 14 and into the housing 24 but prevents the reverse flow of fuel from within the housing 24 into the outlet ports 14. The sealing ring 50 may have a port 90 formed adjacent the inlet side of the pumping assembly 12 to reduce the differential pressure across the ring 50. A hole 92 through the sealing ring 50 receives the bolt 56 while a semi-circular recess 94 provides clearance from the other bolt 54 and nut 58 so that the portion of the seal adjacent the outlet ports 14 may be displaced to permit fuel to flow past the seal 50.

Figure 5:
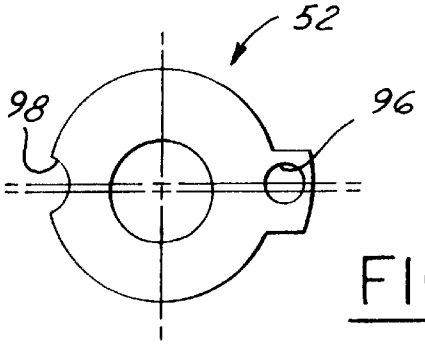
FIG. 5 is a top view of a seal support plate of the fuel pumping assembly.
Figure 6:
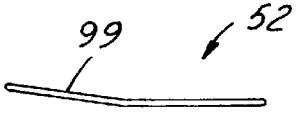
FIG. 6 is a side view of the seal support plate of FIG. 5.

As shown in FIGS. 5 and 6, the seal support plate 52 has a similar plan configuration as the sealing ring 50 and with a hole 96 receiving the bolt 56 and a semicircular recess 98 providing clearance from the other bolt 54 and nut 58. To facilitate discharging liquid fuel from the fuel pumping assembly 12, the support plate 52 has an upwardly canted portion 99 to permit the seal 50 to be displaced from the outlet ports 14 so that fuel may be discharged therethrough.

Figure 2:
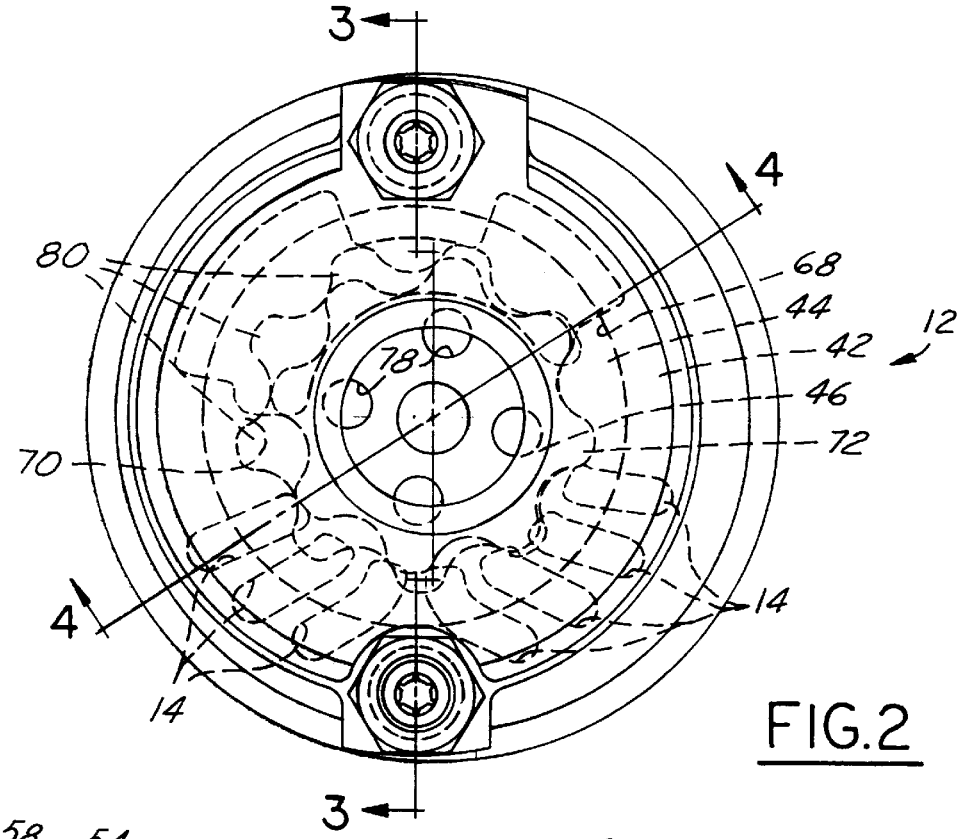
FIG. 2 is a top view of the fuel pumping assembly of the fuel pump of FIG. 1.
Figure 3:
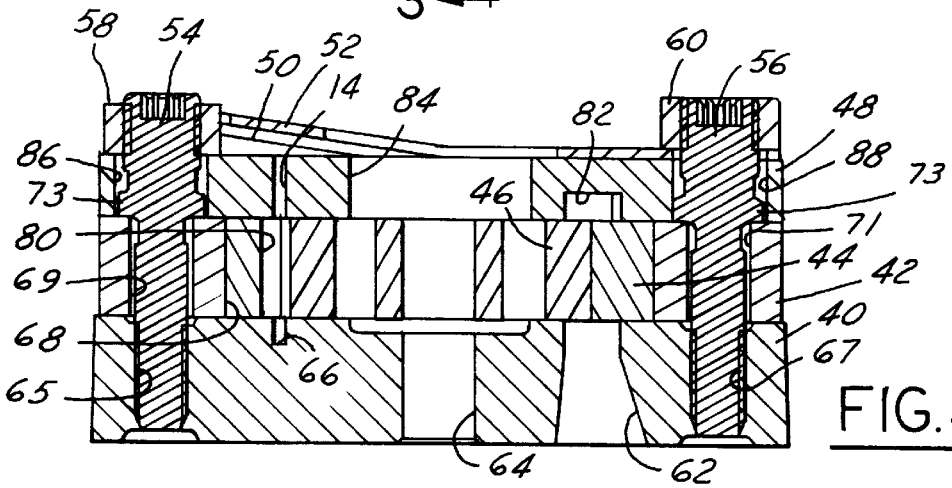
FIG. 3 is a sectional view taken along line 3—3 of FIG. 2.
Figure 4:
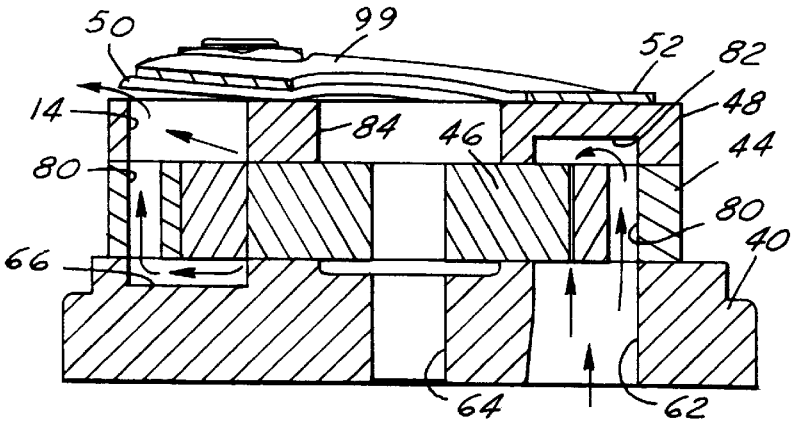
FIG. 4 is a sectional view taken along line 4—4 of FIG. 2.

As best shown in FIG. 2, the outlet ports 14 are preferably radially elongate and circumferentially spaced with the seal 50 completely overlying each of the outlet ports 14. When constructed as shown, at least one outlet port 14 is open to each pumping chamber 80 adjacent the outlet side of the pumping assembly 12 so that if the pressure within that chamber 80 is equal to or exceeds the pressure downstream of the seal 50, the liquid fuel within the pumping chamber 80 can be discharged through an outlet port 14. The outlet ports 14 are also constructed such that adjacent pumping chambers 80 do not communicate through an outlet port 14 which prevents fuel at a higher pressure in a downstream pumping chamber from entering a pumping chamber upstream thereof and thereby rapidly increasing the fuel pressure in the upstream pumping chamber and causing increased cavitation noise as the vapor is rapidly compressed and transformed to liquid fuel.

Figure 8:
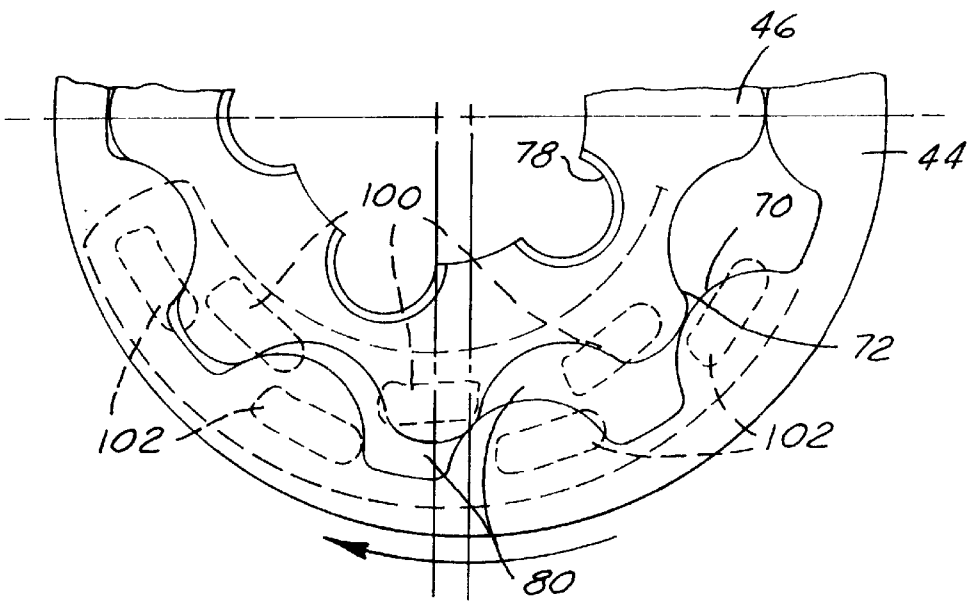
FIG. 8 is a top view of a fuel pumping assembly embodying this invention and having an alternate outlet port plate construction.

One way to achieve this, is to dispose the radially innermost portion of the outlet ports 14 along or just radially outwardly of an arc or circle joining the location of the initial points of contact between the teeth 72 of the inner gear rotor 46 and the teeth 70 of the outer gear rotor 40. With this construction, at their initial engagement, the teeth 70, 72 will provide a seal between adjacent pumping chambers 80 to prevent adjacent pumping chambers 80 from communicating with each other. Another outlet port construction which achieves this result is shown in FIG. 8. As shown in FIG. 8, an inner row of outlet ports 100 are circumferentially spaced from each other and located radially inwardly of the initial contact points between the teeth 70, 72 of the gear rotors 44, 46. An outer row of outlet ports 102 are circumferentially staggered from the inner row of ports 100 and located radially outwardly of the radial location of the initial contact points between the gear teeth 70, 72. With this configuration at least one and usually two ports 100 or 102 are open to a given pumping chamber 80 to discharge fuel from the pumping chambers through the ports 100, 102 without communicating adjacent pumping chambers 80 through any outlet ports 100 or 102.

In use, the electric motor 26 drives the inner gear rotor 46 for rotation through the coupling 74 fixed to the stub shaft 30. The inner gear rotor 46 in turn drives the outer gear rotor 44 for rotation in the bore 68 of the cam ring 42. The rotation of the inner gear rotor 46 and outer gear rotor 44 on their offset axes of rotation produces enlarging and ensmalling of the pumping chambers 80 which draws liquid fuel into the pumping assembly 12 and discharges it therefrom under pressure.

Especially with heated fuel, the drop in pressure adjacent the fuel pump inlet facilitates transformation of liquid fuel to fuel vapor. Under extreme conditions, as an enlarging pumping chamber 80 reaches its maximum volume it may contain up to 60% fuel vapor by volume. The pressure within the enlarging pumping chambers 80 is typically below atmospheric pressure and the pressure within a pumping chamber 80 does not begin to increase until the volume of the pumping chamber 80 begins to decrease as the gears 44, 46 rotate. Further, as the volume of an ensmalling pumping chamber 80 decreases, the pressure therein does not significantly increase until all of the compressible fuel vapor in that chamber 80 is transformed into liquid fuel which is substantially incompressible. After that, any reduction in chamber volume significantly increases the pressure of the liquid fuel within the pumping chamber 80 and when the pressure within that chamber 80 exceeds the pressure downstream of the sealing ring 50, the sealing ring 50 is displaced and the fuel is discharged through one or more outlet ports 14, 100 or 102 communicating with that pumping chamber 80.

The extent to which the volume of a pumping chamber 80 needs to be reduced to compress the fuel vapor and transform it into liquid fuel and thereafter increase the liquid fuel pressure to discharge it through the outlet port 14 is dependent on the amount of fuel vapor present within the pumping chamber 80 when the pumping chamber 80 has its maximum volume. The lower the volume of fuel vapor in the pumping chamber 80, the less the volume of the chamber 80 will have to be reduced to compress the fuel vapor and then increase the liquid fuel pressure therein sufficiently to discharge the fuel through an outlet port 14, 100 or 102. The greater the volume of fuel vapor in a pumping chamber 80, the greater the volume of the pumping chamber 80 must be reduced to compress the fuel vapor and then increase the pressure of the liquid fuel in the pumping chamber sufficiently to displace the sealing ring 50 and discharge the fuel therein through an outlet port 14, 100 or 102.

In previous fuel pumps, the outlet fuel pressure which is typically at an elevated pressure of 40 psi or greater was not prevented from reentering the pumping chambers which may be at a significantly lower pressure and have a significant fuel vapor content therein. Thus, in previous fuel pumps, the higher pressure outlet fuel rushed back into the lower pressure pumping chambers and rapidly increased their pressure thereby rapidly compressing and transforming the fuel vapor therein to liquid fuel causing a loud cavitation noise.

With the sealing ring 50 and outlet port 14, 100 or 102 configuration of the present invention of the fuel pump assembly 12, the outlet fuel pressure as well as fuel at an elevated pressure in downstream pumping chambers 80 is prevented from entering an upstream pumping chamber 80 which avoids the rapid increase in pressure in that chamber and the associated loud cavitation noise. Thus, in the present invention as the gears 44, 46 rotate and the enlarging pumping chambers 80 reach their maximum volume and then begin to become ensmalled, the pressure therein increases more gradually to more gradually compress the vapor and transform the fuel vapor to liquid fuel. This produces a much lower level of cavitation noise which is extremely desirable in operation of the fuel pump 10.

In addition, because there is generally a significant amount of fuel vapor within an enlarged pumping chamber 80 the volume of the pumping chamber 80 must be significantly reduced before the pressure therein is raised sufficiently to displace the seal 50 and discharge the liquid fuel through the outlet ports 14, 100 or 102. While greatly reducing the cavitation noise in the operating fuel pump 100, this also reduces fuel leakage across the gear rotors 44, 46 which occurs both between the port plates 40, 48 and the gear rotors 44, 46 and between adjacent teeth 70, 72 of the gear rotors 44, 46 due to pressure differentials across the gears 44, 46.

In prior fuel pumps, where the outlet fuel or higher pressure fuel downstream of a pumping chamber was permitted to enter a lower pressure pumping chamber, the pressure of a pumping chamber immediately downstream of the inlet side of the pumping assembly was rapidly increased. This resulted in a significant pressure differential between that chamber and the adjacent chamber in the inlet side of the pumping assembly which is at or below atmospheric pressure, causing increased leakage between them. In the present invention, the pressure within an ensmalling pumping chamber 80 is more gradually increased as the vapor therein is compressed and, because significant vapor is generally present during operation of the fuel pump, the pumping chamber does not significantly increase in pressure until its volume is significantly reduced by rotation of the gears 44, 46. After such gear 44, 46 rotation, the pumping chamber 80 and the fuel therein have moved a significant circumferential distance from the low pressure inlet side of the pumping assembly 12. Thus, the highest pressure fuel is separated a greater distance from the low pressure side in the pump assembly 12, thereby increasing the length of the leak flow path and decreasing the amount of fuel leakage and increasing the efficiency of the fuel pump 10 in use.

Further, disposing the seal 50 on top of the outlet port plate 48 as opposed to disposing the seal 50 directly on the gear rotors 44, 46, as in prior fuel pumps such as the pump disclosed in U.S. Pat. No. 5,035,588, eliminates the wear on the seal 50 which was caused by direct contact with the rotating gears 44, 46 in the prior fuel pumps. Thus, the fuel pumping assembly 12 is more durable, reliable, has a longer life in service and may be used with pumps having an output pressure of 200 psi or more.

What is claimed is:

1. A positive displacement gear rotor type fuel pump comprising:

an electric motor which drives the fuel pump;

an inner gear rotor driven to rotate on an axis by the motor and having radially outwardly extending teeth;

an outer gear rotor having radially inwardly extending teeth and driven to rotate by the inner gear rotor on an axis spaced from and parallel to the axis of rotation of the inner gear rotor, the outer gear rotor having at least one more tooth than the inner gear rotor;

a plurality of fuel pumping chambers defined between the teeth of the inner gear rotor and outer gear rotor, the volume of each fuel pumping chamber enlarges to draw fuel into the fuel pumping chamber and ensmalls to increase the pressure of the fuel in the fuel pumping chamber and to discharge the pressurized fuel;

an outlet port plate disposed adjacent the inner and outer gear rotors and having a plurality of spaced apart outlet ports through which fuel under pressure is discharged from the chambers of the inner and outer gear rotors, the outlet ports are radially elongate, circumferentially spaced apart and have their radially innermost portion disposed on or slightly radially outwardly of an arc formed by connecting the initial points of contact between the inner gear rotor teeth and the outer gear rotor teeth, the outlet ports are constructed, spaced apart and arranged so that the fuel pumping chambers do not directly communicate with each other through the outlet ports; and a valve adjacent the outlet ports and constructed to prevent the reverse flow of fuel from downstream of the valve back through the outlet ports whereby the valve prevents pressurized fuel discharged from the fuel pumping chambers from reentering other fuel pumping chambers which are at a lower pressure and the construction and arrangement of the outlet ports prevents the fuel in a fuel pumping chamber which is at a higher pressure than fuel in other fuel pumping chambers from entering the other fuel pumping chambers to reduce the noise associated with the rapid compression and transformation of fuel vapor to liquid fuel and thereby reduce the noise of the operating fuel pump.

2. The fuel pump of claim 1 wherein the valve is a thin, metallic ring connected to the outlet port plate.

3. The fuel pump of claim 1 wherein at least one outlet port is open to each pumping chamber as its volume is decreasing.

4. The fuel pump of claim 1 wherein tooth to tooth contact between the inner gear rotor and the outer gear rotor substantially prevents adjacent ensmalling pumping chambers from communicating with each other through an outlet port.

5. The fuel pump of claim 1 which also comprises a cam ring having a cylindrical bore in which the outer gear rotates, the cam ring has a greater axial height than the inner gear rotor and outer gear rotor and the outlet port plate bears on the cam ring to define a fixed clearance between the inner and outer gear rotors and the outlet port plate.

6. The fuel pump of claim 1 wherein the outlet ports span a substantially complete arcuate path of between about 120° to 160°.

7. The fuel pump of claim 1 wherein the valve comprises a sealing ring overlying the outlet ports and received on the outlet port plate and spaced from the inner and outer gear rotors and a support ring received over the sealing ring and having a portion spaced from the sealing ring and overlying the outlet ports to permit a portion of the sealing ring to be displaced from the outlet port plate so that fuel may be discharged through the outlet ports when the pump is operating.

8. The fuel pump of claim 1 which also comprises a cam ring having a cylindrical bore in which the outer gear rotates, the cam ring has a greater axial height than the inner gear rotor and the outer gear rotor, the outlet port plate bears on the cam ring to define a fixed slight clearance between the outlet port plate and the inner and outer gear rotors, a sealing ring overlying the outlet port and received on the outlet port plate and spaced from the inner and outer gear rotors and a support ring received over the sealing ring and having a portion spaced from the sealing ring and overlying the outlet ports to permit a portion of the sealing ring to be displaced from the outlet port plate so that fuel may be discharged through the outlet ports when the pump is operating.

9. The fuel pump of claim 2 wherein the valve is formed of stainless steel.

10. The fuel pump of claim 7 wherein the sealing ring has a port therethrough adjacent the inlet side of the fuel pump.

11. A positive displacement gear rotor type fuel pump comprising:

an electric motor which drives the fuel pump;

an inner gear rotor driven to rotate on an axis by the motor and having radially outwardly extending teeth;

an outer gear rotor having radially inwardly extending teeth and driven to rotate by the inner gear rotor on an axis spaced from and parallel to the axis of rotation of the inner gear rotor, the outer gear rotor having at least one more tooth than the inner gear rotor;

a plurality of fuel pumping chambers defined between the teeth of the inner gear rotor and outer gear rotor, the volume of each fuel pumping chamber enlarges to draw fuel into the fuel pumping chamber and ensmalls to increase the pressure of the fuel in the fuel pumping chamber and to discharge the pressurized fuel;

an outlet port plate disposed adjacent the inner and outer gear rotors and having a plurality of spaced apart outlet ports through which fuel under pressure is discharged from the chambers of the inner and outer gear rotors, the outlet ports are in two radially spaced rows of circumferentially extending outlet ports with one row of outlet ports disposed radially inwardly of an arc formed by connecting the initial points of contact between the inner gear rotor teeth and the outer gear rotor teeth and the other row of outlet ports disposed radially outwardly of that arc, the outlet ports are constructed, spaced apart and arranged so that the fuel pumping chambers do not directly communicate with each other through the outlet ports; and a valve adjacent the outlet ports and constructed to prevent the reverse flow of fuel from downstream of the valve back through the outlet ports whereby the valve prevents pressurized fuel discharged from the fuel pumping chambers from reentering other fuel pumping chambers which are at a lower pressure and the construction and arrangement of the outlet ports prevents the fuel in a fuel pumping chamber which is at a higher pressure than fuel in other fuel pumping chambers from entering the other fuel pumping chambers to reduce the noise associated with the rapid compression and transformation of fuel vapor to liquid fuel and thereby reduce the noise of the operating fuel pump.

12. The fuel pump of claim 6 wherein the outlet ports span a substantially complete arcuate path of between about 120° to 160°.

13. The fuel pump of claim 11 wherein the valve is a thin, metallic ring connected to the outlet port plate.

14. The fuel pump of claim 11 wherein at least one outlet port is open to each pumping chamber as its volume is decreasing.

15. The fuel pump of claim 11 wherein tooth-to-tooth contact between the inner gear rotor and the outer gear rotor substantially prevents adjacent ensmalling pumping chambers from communicating with each other through an outlet port.

16. The fuel pump of claim 11 which also comprises a cam ring having a cylindrical bore in which the outer gear rotates, the cam ring has a greater axial height than the inner gear rotor and outer gear rotor and the outlet port plate bears on the cam ring to define a fixed clearance between the inner and outer gear rotors and the outlet port plate.

17. The fuel pump of claim 11 wherein the valve is formed of stainless steel.

18. The fuel pump of claim 11 wherein the valve comprises a sealing ring overlying the outlet ports and received on the outlet port plate and spaced from the inner and outer gear rotors and a support ring received over the sealing ring and having a portion spaced from the sealing ring and overlying the outlet ports to permit a portion of the sealing ring to be displaced from the outlet port plate so that fuel may be discharged through the outlet ports when the pump is operating.

19. The fuel pump of claim 11 which also comprises a cam ring having a cylindrical bore in which the outer gear rotates, the cam ring has a greater axial height than the inner gear rotor and the outer gear rotor, the outlet port plate bears on the cam ring to define a fixed slight clearance between the outlet port plate and the inner and outer gear rotors, a sealing ring overlying the outlet ports, received on the outlet port plate and spaced from the inner and outer gear rotor and a support ring received over the sealing ring and having a portion spaced from the sealing ring and overlying the outlet ports to permit a portion of the sealing ring to be displaced from the outlet port plate so that fuel may be discharged through the outlet ports when the pump is operating.

20. The fuel pump of claim 18 wherein the sealing ring has a port therethrough adjacent the inlet side of the fuel pump.

* * * * *

UNITED STATES PATENT AND TRADEMARK OFFICE

CERTIFICATE OF CORRECTION

PATENT NO. : 6,102,684
DATED : August 15, 2000
INVENTOR(S) : Charles H. Tuckey

It is certified that error appears in the above-identified patent and that said Letters Patent is hereby corrected as shown below:

Column 9,
Line 7, delete "claim 6" and insert -- claim 11 --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*